United States Patent [19]

Portillo

[11] 4,416,113

[45] Nov. 22, 1983

[54] INTERNAL EXPANSION ENGINE

[76] Inventor: Francisco Portillo, Ave. Durango Y 12 ESTE #231, Cananea, Sonora, Mexico

[21] Appl. No.: 216,436

[22] Filed: Dec. 15, 1980

[51] Int. Cl.[3] ..... F01K 21/02

[52] U.S. Cl. ..... 60/513; 60/514

[58] Field of Search ..... 60/513, 508, 509, 512, 60/514

[56] References Cited

U.S. PATENT DOCUMENTS

| | | | |
|---|---|---|---|
| 1,063,824 | 6/1913 | Mitchell et al. | 60/513 |
| 1,226,500 | 5/1917 | Fuehler | 60/513 X |
| 1,744,288 | 1/1930 | Vorel | 60/513 |
| 2,984,067 | 5/1961 | Morris | 60/513 |
| 3,990,238 | 11/1976 | Bailey | 60/513 |

*Primary Examiner*—Allen M. Ostrager

*Attorney, Agent, or Firm*—Harry M. Weiss; Charles Paul Padgett, Jr.

[57] ABSTRACT

This disclosure relates to internal expansion engines of the type where a non-combusting operating fluid is vaporized within a cylinder or cylinders so that the vapor upon expansion performs mechanical work. The internal expansion engine utilizes a non-combusting liquid operating fluid, a linkage apparatus for having an expansion chamber for transforming an expansion of the operating fluid into shaft power, and a vaporizing apparatus for expanding the liquid fluid to vapor.

4 Claims, 14 Drawing Figures

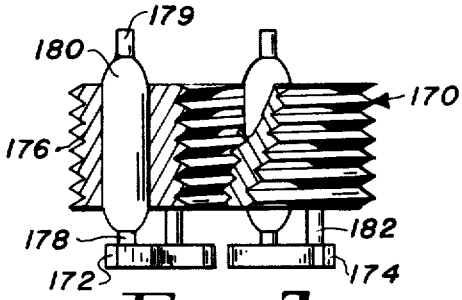
FIG. 2
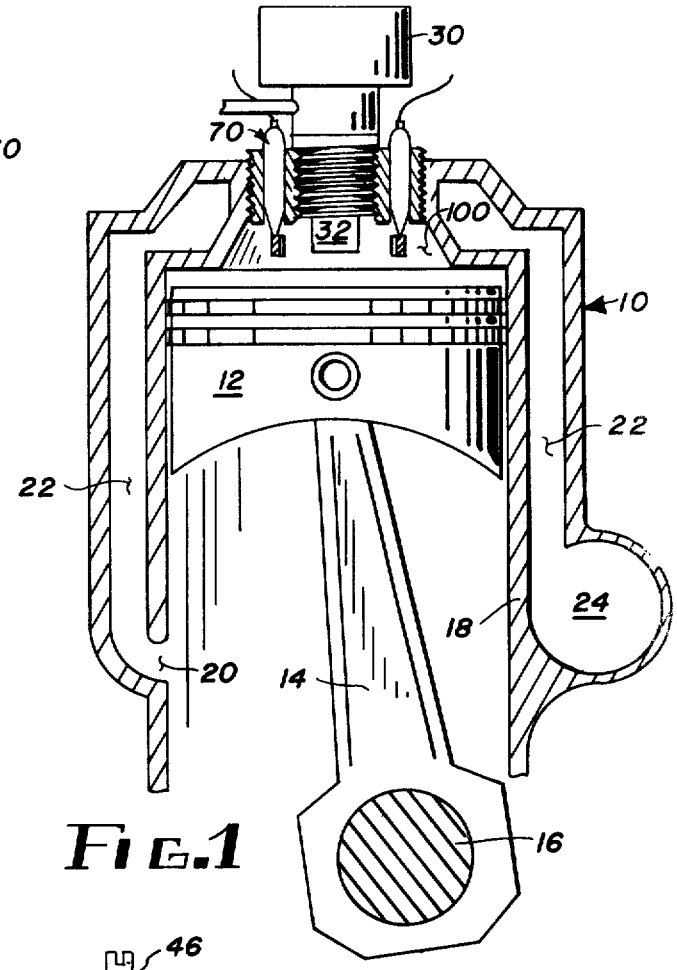
FIG. 1
FIG. 3
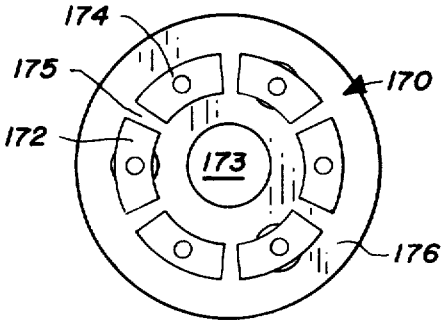
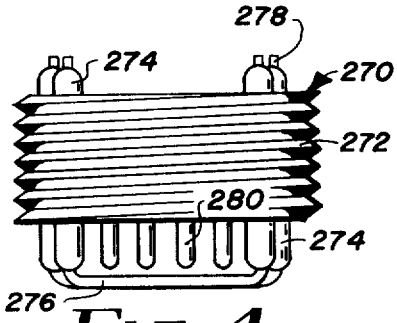
FIG. 4
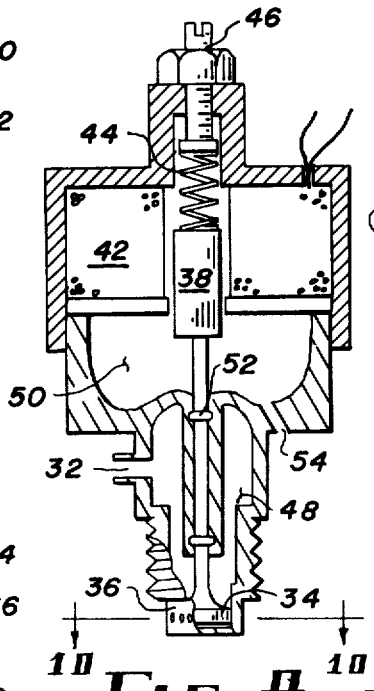
FIG. 8
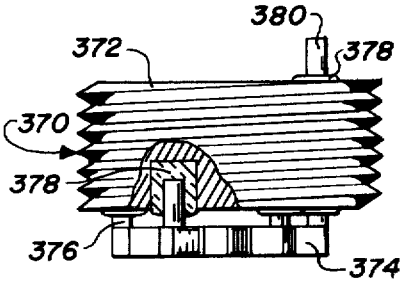
FIG. 6
FIG. 5
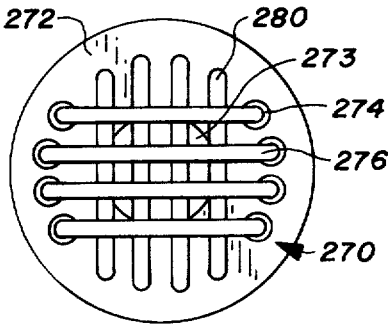
FIG. 7
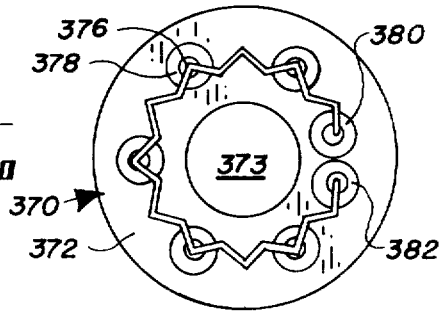

INTERNAL EXPANSION ENGINE

BACKGROUND OF THE INVENTION

1. Field of the Invention

This invention relates generally to internal expansion engines and, more specifically, to engines where a non-combusting operating fluid is vaporized within a cylinder or cylinders, and where that vapor is expanded to perform mechanical work. In as much as no combustion is involved in engine operation, the invention will operate without an atmospheric inlet, and will emit no combustion products or effluent other than vapor of the working fluid. The engine can operate in a closed cycle, permitting use, for example, underwater or in a vacuum. Closed cycle construction is, however, not necessary for proper functioning. The preferred embodiment of the invention is an electrically-driven torque-generating device which has substantial start-up torque available with minimal standby power input requirements.

2. Description of the Prior Art

In the past, shaft power has been widely utilized as a motive force, since at least the introduction of the water wheel. Subsequently, various steam expansion engines were developed, which utilized external combustion sources to provide heated steam. The steam was expanded through a reciprocating piston linkage, or a turbine, to provide a shaft power output. Steam engines had inherent problems, however, in that the external boiler had to be fired substantially before shaft power could be produced.

Electric motors were also developed, and utilized the interaction of moving electromagnetic fields to provide a shaft power output. While various designs for such electric motors were developed, a problem common to each was the relatively low starting torque available.

Internal combustion engines, of both the spark ignition and compression ignition types, were also developed to provide shaft power sources which could be started quickly, consume minimal standby power and could produce substantial torque from a standing start. However, such internal combustion engines presented their own accompanying set of problems, including the local output of atmospheric pollutants in the form of the products of combustion, and the necessity for a continuing replacement of the fuel consumed in operation.

A need existed for an engine or other source of shaft power which: (1) did not require preheating a boiler; (2) did not require that a boiler be kept fired on a standby basis to provide a prompt startup capability; (3) did have substantial torque available from startup; (4) operated in a closed cycle, or in the alternative at least without local combustion product pollutant output; (5) consumed only minimal if any energy under standby conditions; and (6) did not require an input of fuel.

BRIEF DESCRIPTION OF THE DRAWING

FIG. 1 is a sectional view of a cylinder assembly incorporating the invention.

FIG. 2 is a partially sectional view of a first embodiment of the evaporator of the cylinder assembly of FIG. 1.

FIG. 3 is a bottom view of the evaporator assembly of FIG. 2.

FIG. 4 is an elevational view of a second embodiment of the evaporator of the cylinder assembly of FIG. 1.

FIG. 5 is a bottom view of the evaporator of FIG. 4.

FIG. 6 is an elevational view of a third embodiment of the evaporator of the cylinder assembly of FIG. 1.

FIG. 7 is a bottom view of the evaporator of FIG. 6.

FIG. 8 is a sectional elevational view of the operating fluid injector valve of the cylinder assembly of FIG. 1.

SUMMARY OF THE INVENTION

Figure 11:
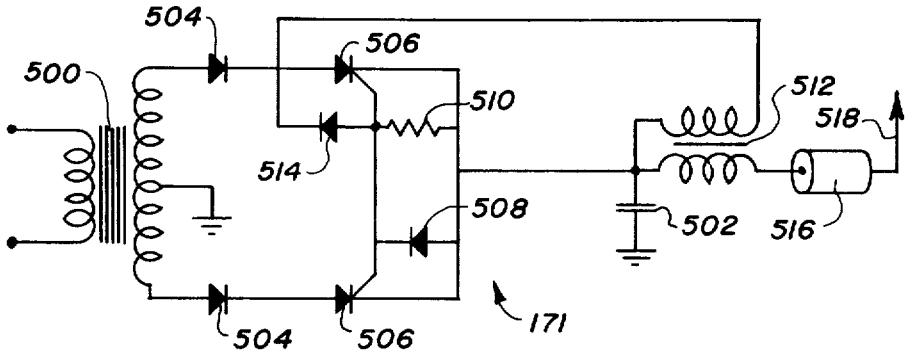
FIG. 11 is a schematic circuit diagram of a power supply which can be used to activate the evaporator of FIGS. 2 and 3.

In accordance with one embodiment of this invention, it is an object to provide an injection-triggered vapor expansion engine.

It is another object to provide a vaporizing apparatus for a non-combustible operating fluid in an injection triggered vapor expansion engine.

It is a further object to provide a power supply for a vaporizing apparatus in an injection triggered vapor expansion engine which electrically discharges to generate a vaporizing arc when liquid operating fluid is injected into the engine.

It is again another object to provide a power supply for a vaporizing apparatus in an injection triggered vapor expansion engine which is capable of delivering apparent power in excess of the actual instantaneous electrical power input.

It is yet a further object to provide a power supply for a vaporizing apparatus in an injection triggered vapor expansion engine which isolates an electrical power input source from excessive power demands of the vaporizing apparatus.

It is an object to teach a method of generating force with an injection-triggered expansion cycle.

DESCRIPTION OF THE PREFERRED EMBODIMENTS

In accordance with one embodiment of this invention, an expansion engine system is disclosed, comprising: a non-combusting liquid operating fluid; a piston linkage means having an expansion chamber for transforming an expansion of said operating fluid into shaft power; and vaporizing or evaporating means for expanding said liquid operating fluid to vapor.

In accordance with another embodiment of this invention, a method of generating force is disclosed comprising the steps of: providing an expansion chamber, generating an electrical potential across a spark gap in said expansion chamber; injecting a liquid operating fluid into said spark gap; discharging said electrical potential; vaporizing said operating fluid with said electrical discharge; expanding said vaporized fluid to move at least a portion of the expansion chamber; and performing work from the movement of some movable portion of said expansion chamber.

The foregoing and other objects, features and advantages of this invention will be apparent from the following more particular description of the preferred embodiment of the invention as illustrated in the accompanying drawings.

FIG. 1 illustrates the disclosed invention as essentially a vapor-driven, injection-triggered engine, shown generally by reference number 10. The engine or piston linkage means 10 is provided with a piston 12, which is coupled in a conventional manner by a connecting rod 14 to a crankpin 16 of a crankshaft. While the illustrated embodiment of the engine utilizes a reciprocating power transmission linkage, it will be apparent to one skilled in the art that the invention could also be practiced with other forms of power transmission linkage, such as a multilobe-rotor-driven output shaft, or turbine driven output shaft.

The piston 12 is free to reciprocate in a block 18 in a conventional manner. In a timed relationship to the arrival of the piston 12 at top dead center (TDC), a pressurized liquid operating fluid is injected by a solenoid valve 30 into an expansion chamber 100 above the piston 12. The operating fluid is flashed into vapor by an evaporator assembly shown generally by reference number 70, whereupon piston 12 is driven down by the liquid/vapor expansion to rotate the crankshaft in the conventional manner. As piston 12 approaches bottom dead center (BDC), after rotating the crankshaft through nearly a 180 arc, a cylinder port 20 is uncovered, allowing spent vapor to exhaust. To capture residual heat and improve cylinder scavenging, the cylinder is preferably jacketed by vapor passages 22 which terminate in a final exhaust outlet 24. The cylinder port 20 is positioned and dimensioned to avoid conflict with the spacing of piston rings. Air or residual vapor remaining in the cylinder after the downstroke does not substantially impair engine operation in that power required for compression on the upstroke is substantially recovered on the following downstroke.

A one cylinder version of the engine 10, as shown in FIG. 1, will require a flywheel (not shown) to store sufficient angular momentum to return the piston 12 to TDC after the power stroke. Multiple cylinder versions of the engine 10 are also possible. To smooth the power flow, for example, a three cylinder version having crankpins 16 spaced 120° apart will exhibit 60° to power overlap between cylinders.

FIGS. 2, 4 and 6 show three different embodiments of the evaporator assembly 70, each designed for a correspondingly different type of power supply, as hereinafter explained.

A first embodiment of the evaporator assembly 70 is shown generally in FIGS. 2 and 3 by reference number 170. The evaporator 170 is designed for use with an energy storage type of power supply. In FIG. 2, the evaporator 170 is shown with portions removed to reveal the internal structure. Alternating high potential electrodes 172 and ground electrodes 174 are installed in a generally annular configuration about the threaded aperture 173 which mounts the injection valve 30. An adjacent pair of the electrodes 172, 174, defines a spark gap 175.

The electrodes 172, 174 are mounted on a threaded metal plug 176, which screws into the top of the block 18 to mount the evaporator assembly 170 in the engine 10. The high potential electrodes 172 are supported by stainless steel terminal rods 178 embedded in electrical grade ceramic bushings 180. The ceramic bushings 180 are cemented into the metal plug body 176 with a glass frit, and electrically isolate the electrodes 172 from the metal plug body 176. The ground electrodes 174, resting between the high potential electrodes 172, are electrically grounded through stainless steel rods 182 directly attached to the metal plug body 176. The terminal rods 178 extend completely through the ceramic bushings 180 and the plug body 176. The exposed ends 179 of the insulated terminal rods 178 are electrically connected to a power supply 171 (refer to FIG. 11).

A second embodiment of the evaporator assembly 70 is shown generally in FIGS. 4 and 5 by reference number 270. The evaporator 270 is designed for use with a demand type power supply. An evaporator plug body 272 mounts closely spaced electrically insulating bushings 274 in opposed pairs. The bushings 274 are electrically insulating ceramic material. High tension electrode wires 276 span between corresponding pairs of insulating bushings 274. The bushings 274 also enclose and insulate conductors 278 which protrude to permit an external power supply 271 (refer to FIG. 12) to be connected to the high tension electrode wires 276. For durability, each of the electrodes 274, 280 is preferably a tungsten wire. The resulting evaporator assembly 270 consists of a grid of insulated and grounded tungsten wires, with typical 10 mm. gaps at the crossover points.

A third embodiment of the evaporator assembly 70 is shown generally in FIGS. 6 and 7 by reference number 370. The evaporator 370 is a resistance heater, designed for steady state operation. An evaporator plug body 372 supports the active element 374, which comprises a corrugated length of nichrome ribbon. The ribbon 374 is formed around the injection valve opening 373, and is welded to a series of rods 376 which are supported in electrically insulating bushings 378 set in the evaporator plug body 372. The support rods 380, 382 at each end of the ribbon 374 are electrically conductive members, and extend through, but are insulated from, the evaporator plug body 372 to permit an external power supply 371 (refer to FIG. 13) to be connected to the evaporator assembly 370.

FIG. 8 is a sectional elevational view of the solenoid operated fluid injector valve 30 of FIG. 1. Operating fluid is introduced into the valve 30 through inlet fitting 32 under a typical pressure of 35 to 100 pounds per square inch. A longitudinally actuated closely fitted slug 34 slidably rests within an injector cage 36, and is connected to a solenoid armature 38.

Figure 9:
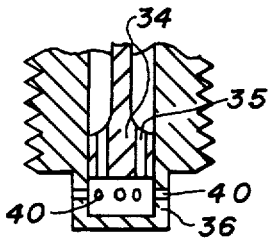
FIG. 9 is an enlarged sectional view of the discharge portion of the valve of FIG. 8.
Figure 10:
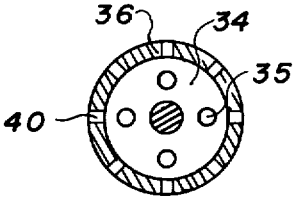
FIG. 10 is a sectional view taken along line 10—10 of FIG. 8.

Referring also to FIGS. 9 and 10, the slug 34 is shown provided with longitudinal apertures 35 which permit operating fluid to travel therethrough. The cage 36 includes a generally cup-shaped cage member having a top opening, a generally cylindrical bore disposed downwardly from said opening, a closed bottom portion terminating the opposite end of said bore, the side walls of said cage bore are pierced by a plurality of radial apertures 40, open to the expansion chamber 100.

The slug 34 is dimensioned or sized to sealably fit within said cage bore to seal the apertures 40 until a solenoid 42 is energized to lift the solenoid armature and the slug 34, to thereby permit injection of the operating fluid. The operating fluid is driven by inlet pressure through the longitudinal apertures 35 in the partially lifted valve slug 34 (refer to FIG. 10) and thence from the bore through the cage apertures 40. When the solenoid 42 is released, a spring 44 drives the slug 34 downward into the cage bore to again seal the injection apertures 40. When closed, the injector valve slug 34 rests within the injector cage 36 so that cylinder pressure simply produces a symmetric load on the peripheral surface of the slug 34. To permit operation at speed, solenoid return spring 44 is relatively stiff, and the solenoid current is correspondingly high. The compression on the spring 44 can be adjusted by screw 46. Leakage of the operating fluid from pressure cavity 48 into the solenoid cavity 50 is prevented by seals 52. The solenoid cavity 50 is also provided with a bleeder hole 54 to drain any operating fluid which migrates past seals 52.

Figure 12:
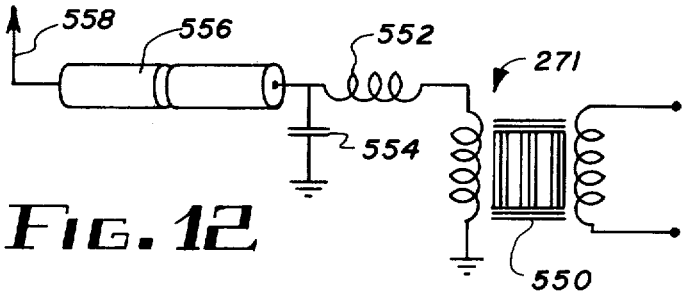
FIG. 12 is a schematic circuit diagram of a power supply which can be used to activate the evaporator of FIGS. 4 and 5.
Figure 13:
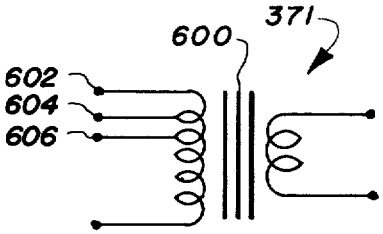
FIG. 13 is a schematic circuit diagram of a power supply which can be used to activate the evaporator of FIGS. 6 and 7.

FIGS. 11, 12 and 13 show schematics of the three power supplies designed to operate with the respective evaporator assemblies shown in FIGS. 4, 6 and 8. FIG. 11 shows a high energy capacitor discharge system. Step up transformer 500 has a power rating corresponding to the required engine power output, with allowance made for mechanical inefficiencies in operation. A center tapped secondary of transformer 500 charges a capacitor bank 502 through series connected rectifiers 504 and silicon controlled rectifiers 506. The silicon controlled rectifiers 506 are biased to conduct by diode 508 and resistor 510. When fluid is introduced into the spark gaps 175 in the evaporator 170, the capacitor bank 502 discharges through the primary of pulse transformer 512, whose secondary windings transform a voltage which biases diode 514 into conduction and thereby momentarilly cuts off silicon controlled rectifiers 506 at the AC zero point to avoid a destructive short circuit across the secondary of transformer 500 and the power rectifiers 504. Ferrite sleeve 516 is installed about leads 518 from the power supply 171 to the evaporator 170, to increase the inductance of the circuit, thereby permitting a discharge of apparent electrical power in excess of the actual instantaneous power input, to assure complete vaporization of the operating fluid injected by valve. In spite of the very high C to L ratio, the discharge of capacitors 502 will generate a damped oscillation in the Megahertz range and produce a vapor-based plasma arc across the spark gaps 175 in the expansion chamber 100. The arc across the gaps 175 continues until the capacitor bank 502 is fully discharged. The energy in Joules (or Watt seconds) stored in the capacitor bank 502 is equal to $e^2C,/2$ where C is in Farads, and the energy in the distributed inductance of the connecting lead is equal to $i^2L/2$ where L is in Henrys. The energy stored in capacitor bank 502 is discharged when fluid is introduced into the spark gaps 175 in evaporator 170 shown in FIG. 2. An engine 10 of more than one cylinder will require an increase in the charging rate of the capacitor bank 502 and the power supply output rating.

FIG. 12 shows a demand type AC power supply 271 which will drive a discharge across the spark gaps in the evaporator unit 270 as long as fluid is injected into the expansion chamber 100, whereas in contrast, with a power supply 171 of the capacitor discharge type, a discharge can occur across the spark gaps only when the capacitors 502 have a residual charge. Transformer 550 is rated to meet the power output requirement of the engine, in addition to mechanical power losses. The transformer 550 is equipped with a magnetic shunt between primary and seconary which avoids damage which would otherwise be caused by the comparative virtual short circuit which occurs when the operating fluid triggers an ionizing discharge across the electrode gap. The secondary of transformer 550 operates at approximately 4800 volts, which approaches the voltage at which spontaneous discharge across the electrode gaps, even in the absence of fluid, may take place. Air core coil 552 isolates the shunting effect of the secondary of transformer 550 from capacitor 554. Ferrite sleeves 556 are installed on the wire 558 leading to electrode connection 278. Gaps in evaporator assembly 270 operate in conjunction with capacitor 554, and the self-inductance of the ferrite loaded connection wire 558 to provide an effective damped wave generator with a high KVA to KW ratio for efficient evaporator operation. The discharge frequency of the oscillating power supply circuit shown in FIG. 12 can be calculated approximately as follows:

$$f = \frac{1}{2\pi\sqrt{LC}}$$

where c is in Farads and L in Henry's and the energy of the discharge in watt seconds is as follows:

$$w = \frac{e2}{2r\sqrt{LC}}$$

where r includes the gap resistance, (which is a desirable feature for the generation of a plasma arc containing vapor circuit losses).

FIG. 13 shows a power supply 371 which is designed to operate on a steady state basis. In the supplies shown in FIGS. 4 and 6, the supply discharge is triggered by the introduction of fluid into an air gap, whereas in the supply shown in FIG. 8, a heated resistive element (Item 374 in FIG. 6) operates on a continuous basis but is periodically sprayed by the working fluid which is flashed into vapor. Stepdown transformer 600 in FIG. 13 is equipped with primary end taps 602, 604 and 606 which will permit adjustment of the operating temperature of the nichrome ribbon 374 to about 1200 degrees C. under the conditions of engine operation. The resistance of nichrome ribbon 374 at such an elevated temperature will increase approximately 17 percent above standard temperature. Thus, if the operating current of the evaporator assembly 370 is 100 to 120 amps, the resistance will be from 0.5 to 0.6 ohms. Since P=I R and E=IR, the power input to the evaporator will be from 5 to 8 kilowatts, and the secondary voltage of transformer 600 should be from 50 to 70 volts as obtained through adjustment of the primary end taps. If a multi-cylinder engine is constructed, the rating of the power supply 371 must be increased accordingly.

Figure 14:
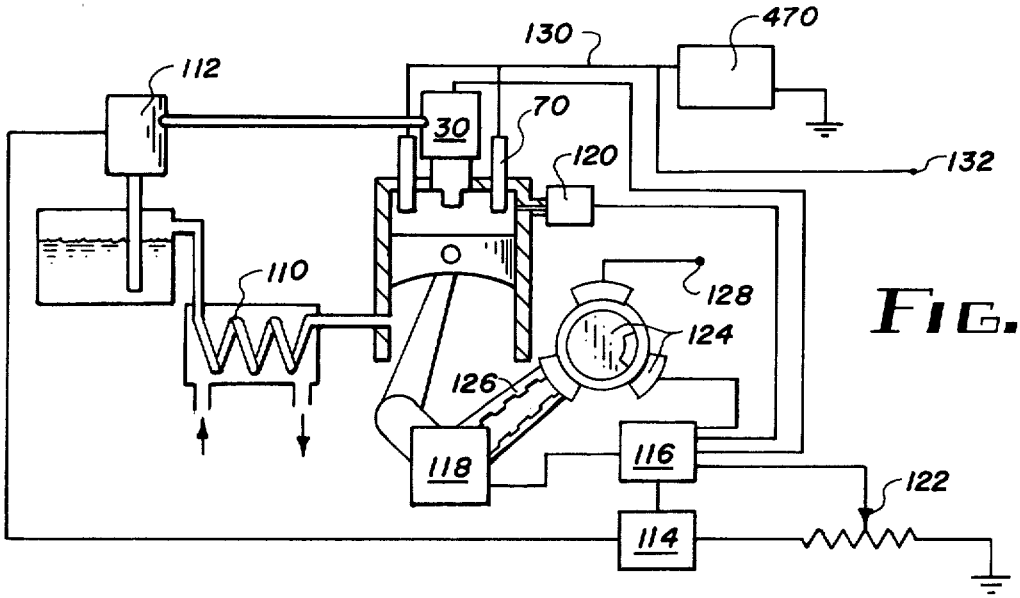
FIG. 14 is a schematic diagram of the cylinder assembly of FIG. 1 functionally coupled in an operating system.

FIG. 14 is a schematic diagram showing external elements required to make the single cylinder engine 10 shown in FIG. 1 operational. As in FIG. 1, a first of what may be, if desired, a plurality of cylinders is shown. Previously identified elements of the engine 10 are labeled with the same reference numbers. The exchanger shown at 110 may be a simple spray chamber in the case of a water injected engine 10 operating with an atmospheric exhaust, or where the engine 10 is to be operated in a closed cycle with a sealed exhaust, a liquid or air cooled heat exchanger 72 may be used as shown. Item 112 is a motor-driven constant pressure injector pump delivering operating fluid under injection pressure. Item 114 shows a DC power supply which selectively energizes solenoid-operated fluid injector valve 30 and the injector pump 112. The duration of pulses driving injector valve 30 is controlled by drive amplifier 116 which in turn is controlled by an engine revolution counter/transducer 118 and a cylinder mean effective pressure transducer 120 connected to 116. A variable resistance throttle controller is shown at 122. A low tension distributor 124 is driven by a coupling 126 from the crankshaft and timed to operate the solenoid injector valve 30.

For operation at higher rotational speeds, any of a series of conventional advance mechanisms could be utilized to control the timing of the injection pulse to optimize power output. If an engine 10 of more than one cylinder is constructed, additional, correctly spaced, low tension contactors as shown at 128, must be used. Any of the three types of energizing power supplies 171, 271, and 371 may be coupled to an electrically compatible evaporator 70, connected as shown at 130. Due to the high voltage and peak currents encountered in power supplies 171 and 271 and the high average current in supply 371, no effort is made to distribute the supplies from cylinder to cylinder and all cylinders are connected in parallel as shown by connection 132 with the power stroke in each respective cylinder being activated by the presence of operating fluid.

The voltages generated by power supplies described in FIGS. 11 and 12 are potentially lethal. The high-tension parts of the power supplies, notably including the capacitors and the electrical connections to the evaporator assemblies, must be protected for safety. The energy storage parts of power supplies described in FIGS. 11 and 12 are recharged at a 120 Hertz rate so engine speeds up from 600 to 3600 RPM are feasible (10 to 100 piston movements per second).

Operating at a total energy input of eight to ten horsepower, a typical example of the engine described in FIG. 1 will convert 100 to 120 liters of water per hour to steam which can be condensed and reused on a continuous basis by heat exchanger 110 shown in FIG. 14. At ten piston movements per second (600 RPM), the solenoid injector 30 will inject three milliliters of water each time the piston is at top dead center, which is equivalent to water consumption of 30 milliliters (one oz.) per second.

While the invention has been described with respect to preferred physical embodiments constructed in accordance therewith, it will be apparent to those skilled in the art that various modifications and improvements may be made without departing from the scope and spirit of the invention.

I claim:

1. An expansion engine system, comprising:

a source of non-combusting liquid operating fluid;

a solenoid-operated fluid injector valve means including a solenoid having a central aperture, spring means operatively disposed in said aperture, an armature means adapted to move longitudinally up and down within said aperture, said spring means for normally biasing said armature longitudinally at least partially out of said aperture and said armature means being responsive to the energization of said solenoid for moving longitudinally upward against said spring bias and substantially within said aperture said fluid injector valve means further including a pressure cavity, an inlet to said pressure cavity for supplying said liquid operating fluid from said supply thereto, injection cage means operably disposed at the lower longitudinal end of said fluid injector valve, said cage means including a generally cup-shaped member having a top opening to a generally cylindrical bore and a closed bottom, a plurality of radial apertures operably disposed about the periphery thereof for injecting said operating fluid from said bore under inlet pressure, a longitudinally activated slug means dimensioned to be operatively received within said bore of said cage means and having a plurality of longitudinally aligned feed apertures communicating said pressure cavity with said cage bore, one side of said slug means being operatively coupled to said solenoid armature for moving longitudinally up and down therewith and substantially in and out of said cage bore, said slug means having walls for operatively sealing the radial output injection apertures of said cage means with said slug walls and for sealing the bottom apertures of said slug means against said closed bottom of said cage bore whenever said armature is at least partially out of said armature, and being responsive to the energization of said solenoid to lift longitudinally upward as said armature moves against said spring bias into said aperture for unsealing said radial cage apertures and feeding said liquid operating fluid from said pressure cavity under inlet pressure through the longitudinal feed apertures of said plug means into said cage bore for injection through the radial apertures thereof to permit fluid injection therefrom.

a motor-driven constant pressure injector pump means for supplying said non-combusting operating fluid under pressure from said source into said inlet of said solenoid-operated fluid injector valve means;

linkage means including a cylinder block, a piston having a piston face, said piston being adapted to move longitudinally up and down within said cylinder block, said cylinder block having an exhaust port, a rotatable shaft, and means operatively coupled between said piston and said shaft for translating said reciprocating piston movement into shaft rotation for doing work and the like, said linkage means also including an expansion chamber operably disposed longitudinally above said piston face for transforming an expansion of said operating fluid therein into a longitudinally downward movement of said piston within said cylinder block, said cage means being operably disposed into said expansion chamber for injecting said operating fluid therein, and condenser means being operably coupled to said cylinder block for condensing said operating fluid vapor exiting said exhaust port for improving the flow efficiency of the engine;

control means for timing the injection of said liquid operating fluid into said expansion chamber;

evaporation means for rapidly vaporizing said injected liquid operating fluid into a vapor state;

said evaporation means to be operably coupled into said cylinder housing and disposed within said expansion chamber for vaporizing operating fluid coming into contact therewith;

power supply means for controlling the energization of said evaporation means.

2. The expansion engine system of claim 1 wherein said evaporation means includes a grounded electrode operably disposed within said expansion chamber, at least one high potential electrode operatively disposed within said expansion chamber, threaded casing means for operatively securing said electrodes within said expansion chamber, electrically isolated terminal means extending through said threaded casing and insulated therefrom for operatively coupling said electrodes to said terminal means; and wherein said power supply means includes a high energy capacitor discharge system including a bank of storage capacitors, a step-up transformer with a primary coil and a center-tapped secondary coil, rectifier means operatively coupling said secondary to said capacitor bank for electrically charging same;

diode means responsive to the introduction of said operating fluid into the spark gap between said electrodes for generating a capacitor discharge signal, and means responsive to said capacitor discharge signal for discharging said capacitor bank through said primary coil to supply the evaporation terminals with the energy stored in the bank of capacitors and permitting an electrical discharge of apparent electrical power substantially in excess of the actual instantaneous power input to assure complete and almost instantaneous evaporation of the operating fluid injected by said solenoid-operated valve.

3. The expansion engine system of claim 1 wherein said evaporation means includes a threaded plug adapted to be operatively disposed in said cylinder housing and into said expansion chamber, a plurality of insulated terminal rods including a first group of wires passing through said threaded plug means and across the bottom thereof before going back up the plug means to a corresponding terminal rod, said first group of electrode wires being substantially parallel to one another, said plurality of terminal rods further including a second group of wires extending through said plug means, across the bottom thereof, and back to corresponding terminals, said second group of electrodes being substantially parallel to one another and substantially perpendicular to the first group, said first and second groups being arranged at the bottom of said plug means such that a spark gap exists between vertically adjacent wires and said plurality of wires form a grid of electrodes disposed proximate the bottom of said threaded plug means, said wires being insulated from each other and from said plug bottom, and selected ones of said wires are grounded while others are conductive for generating arc discharges in the gaps therebetween; and said power supply means further including a demand-type power supply for electrically discharging across the spark gaps on the grid for as long as said operating fluid is injected into the expansion chamber.

4. The expansion engine system of claim 1 wherein said evaporation means includes a threaded casing, insulated bushings passing through said casing, means for operatively disposing said threaded casing in said cylinder housing and into said expansion chamber; at least one conduction terminal rod for conducting electricity and one ground terminal, means for electrically insulating said at least one rod and a second ground rod, said rods extending through said bushings into said expansion chamber, a resistive heating element operably disposed about the bottom of said threaded casing, means for operably coupling one end of said conductive terminal to one end of said resistive heating element and for connecting said ground electrode to the opposite end thereof, means for insulating said resistive heating element from the base of said casing and wherein said power supply means includes a steady state power supply for continually supplying power to said terminals for continually operating said heater element during the operation of said engine system whether or not said operating fluid is being injected at any given time.

* * * * *